United States Patent [19]

Ambasz

[11] Patent Number: 4,844,215

[45] Date of Patent: Jul. 4, 1989

[54] EXPANDABLE LUGGAGE

[76] Inventor: Emilio Ambasz, 295 Central Park West, New York, N.Y. 10024

[21] Appl. No.: 253,734

[22] Filed: Oct. 5, 1988

[51] Int. Cl.[4] ..... A45C 7/00

[52] U.S. Cl. ..... 190/105; 190/104

[58] Field of Search ..... 190/103, 104, 105

[56] References Cited

U.S. PATENT DOCUMENTS 2,475,961 7/1949 Hilbert ..... 190/105

FOREIGN PATENT DOCUMENTS 2026 of 1927 Australia ..... 190/103
802174 2/1951 Fed. Rep. of Germany ..... 190/104
295247 8/1928 United Kingdom ..... 190/105

*Primary Examiner*—William Price

*Attorney, Agent, or Firm*—Brumbaugh, Graves, Donohue & Raymond

[57] ABSTRACT

An item of expandable luggage comprises top and bottom walls and side walls extending between the top and bottom walls to form an enclosed space, the side walls being composed of a top section, a bottom section and an intermediate section and each such section extending continuously along the walls coextensively with the perimeters of the top and bottom walls. The top and bottom sections are U-shaped in cross-section throughout their extents to form a pocket between a pair of wall parts and are oriented with the openings of the pockets facing each other. The intermediate section is received telescopically between the wall parts in sliding relation. Latches retain the top and bottom wall sections in at least two selected spacial relationships relative to each other.

9 Claims, 3 Drawing Sheets

EXPANDABLE LUGGAGE

BACKGROUND OF THE INVENTION

It is a nuisance to carry around a large half-empty briefcase, overnight case, piece of luggage, sample case, tool case, or the like. It is equally a nuisance to find that an item of luggage (the term "luggage" is used herein in a broad sense to refer to all manner of transportable carrying cases) at hand is too small to accept the articles one desires to place in it. Various forms of expandable luggage have been proposed, but few are commercially available. There is a need for inexpensive, durable, attractive expandable luggage, and the object of the present invention is to meet that need.

SUMMARY OF THE INVENTION

There is provided, in accordance with the present invention, an item of expandable luggage comprising top and bottom walls and side walls extending between the top and bottom walls to form an enclosed space. The side walls are composed of a top section, a bottom section and an intermediate section, each such section extending continuously along the walls coextensively with the perimeters of the top and bottom walls. The top and bottom sections are U-shaped in cross-section throughout their extent to form a pocket between a pair of wall parts and are oriented with the openings of the pockets facing each other. The intermediate section is received telescopically between the wall parts in sliding relation. Latches retain the top and bottom wall sections in at least two selected spacial relationships relative to each other.

In preferred embodiments, the top and bottom wall sections may be identical and may be of an injection-molded polymeric material. The intermediate section may comprise inner and outer walls joined in spaced-apart relation by stiffening ribs and may also be of an injected-molded polymeric material. Compression springs can be interposed between the top and bottom wall sections under compression within compartments defined by ribs, whereby the item automatically enlarges when the latch means is released. Additional features include hinges joining the top wall along one edge to a corresponding edge of the top wall section and a carrying handle affixed to the intermediate wall section.

A preferred latch includes a latch member slideably mounted on the intermediate side wall section for movement between a release position and a latch position, at least one E-slot on the latch member, and lugs on the top and bottom wall sections received in the E-slot and adapted to be received selectively in a center leg of the E-slot or in the end legs of the E-slot. A spring biasses the latch member toward the latched position.

For a better understanding of the invention, reference may be made to the following description of an exemplary embodiment, taken in conjunction with the accompanying drawings.

DESCRIPTION OF THE EMBODIMENT

Figure 1:
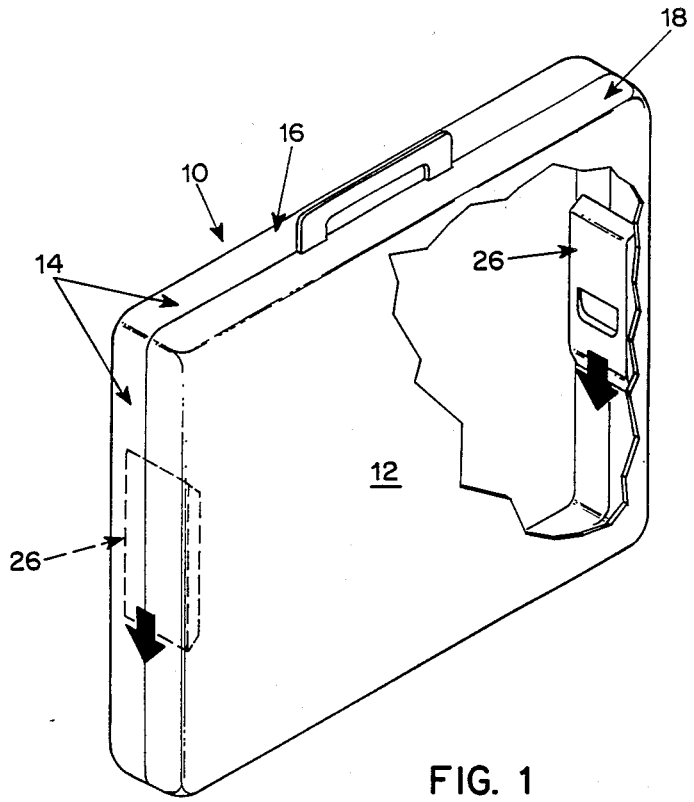
FIG. 1 is an isometric view of the embodiment in its collapsed condition; a portion of the bottom wall being broken away to reveal one of the latches.

A variable volume space for carrying articles of all sorts is defined by top and bottom walls 10 and 12 and side walls 14 extending transversely between the top and bottom walls and coextensively with the perimeters of the top and bottom walls. The embodiment is substantially rectangular in all aspects (top, bottom and all four side sections) but there are few constraints on the shapes. For example, the top and bottom walls can be bulbous or dome-like or irregularly shaped, and the perimeter of the top and bottom walls can be of any desired shape in plan, the side walls being correspondingly shaped. The height between the top and bottom walls at the perimeter can vary. Because of the telescoping construction of the side walls, however, they must be cylindrical (in the geometric sense of moving a straight line around an axis along any desired path, keeping the line parallel to the axis.

The side walls 14 are composed of a top section 16, a bottom section 18 and an intermediate section 20, each of which extends continuously around the enclosed space coextensively with the perimeters of the top and bottom walls. In the embodiment the top and bottom sections 16 and 18 are identical, which offers economics in production because tooling costs are a significant part of total production costs. The top and bottom sections need not, however, be identical. It is preferred to make the three sections of the sides 14 from a high impact strength polymeric material, such as polypropylene, by injection-molding.

The sections 16 and 18 are of substantially uniform, generally U-shaped cross-section throughout their extents and include inner wall portions **16*a*, 18*a*, outer wall portions 16*b*, 18*b* and base portions 16*c*, 18*c* that include a V-shaped segment arranged to present an oblique landing wall area 16*d*, 18*d* for a downturned peripheral flange portion 10*a*, 12*a* of the respective top and bottom walls 10 and 12. The respective wall portions 16*a*, 16*b* and 18*a*, 18*b* define cavities 16*e*, 18*e* that open toward each other and telescopically receive the intermediate wall section 20**.

The intermediate wall section 20 comprises inner and outer wall portions **20*a*, 20*b* joined by a web portion 20*c* that runs continuously in the peripheral direction and ribs 20*d* extending heightwise and located at a suitable spacing. In the assembled wall 14, the extremities of the section walls 16*a*, 16*b*, 18*a*, 18*b* bear against and are supported by the intermediate section, which constitutes a stiff and strong load-bearing member for the middle part of the wall 14**. Of course the base portions 16*c*, 18*c* of the sections 16, 18 are likewise stiff and strong.

Figure 2:
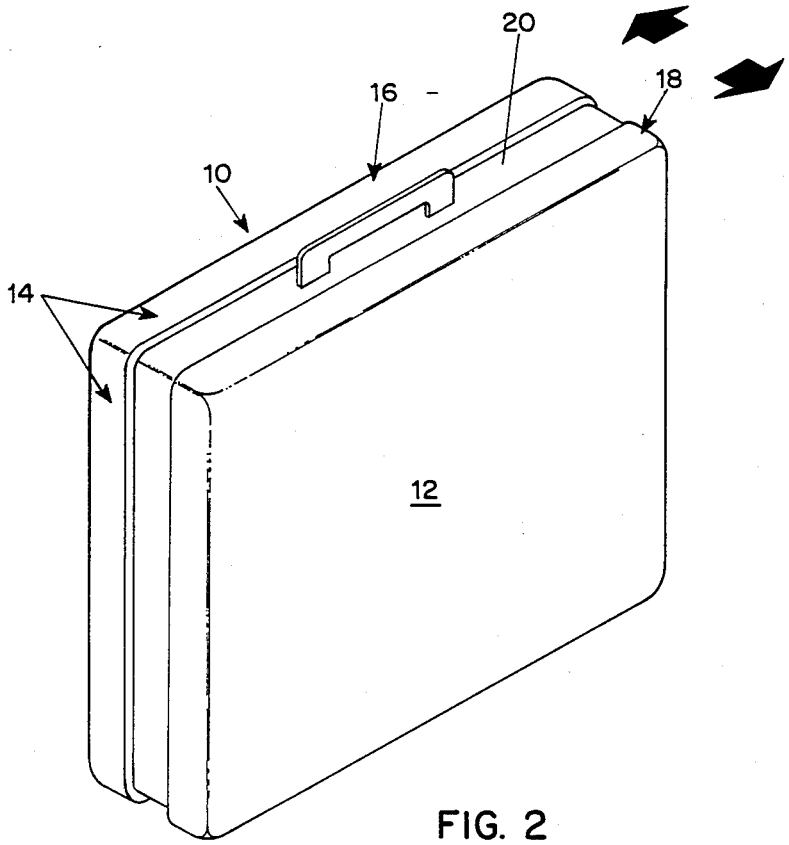
FIG. 2 is an isometric view of the embodiment in its expanded condition.
Figure 3:
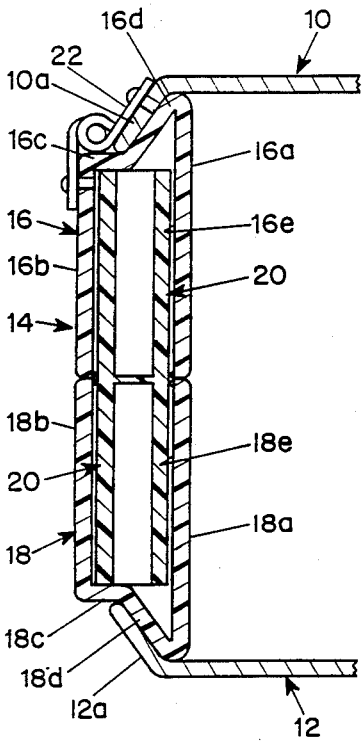
FIGS. 3 and 4 are end cross-sectional views typical for all four side walls and show the collapsed and expanded conditions, respectively.
Figure 4:
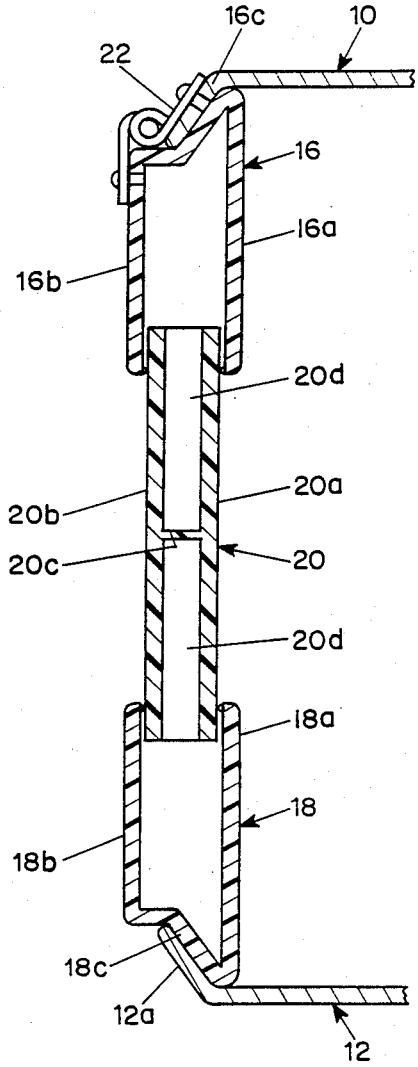

The top and bottom walls 10 and 12 of the luggage are formed of any durable sheet material, such as plastic, fiberglass, fiber board or metal. The bottom wall 12 is suitably joined along the landing wall 18*d*, preferably by an adhesive or by fusion or chemical bonding. The top wall 10 is joined by hinges 22 (FIG. 4) at one edge so as to open. Latches (not shown) of any conventional design releasably hold the top wall closed. A carrying handle 24 (FIGS. 1 and 2) is attached to the intermediate wall section, the wall portions 16*b*, 18*b* being notched to enable the top and bottom wall sections 16 and 18 to meet in the collapsed condition (See FIG. 3).

Figure 9:
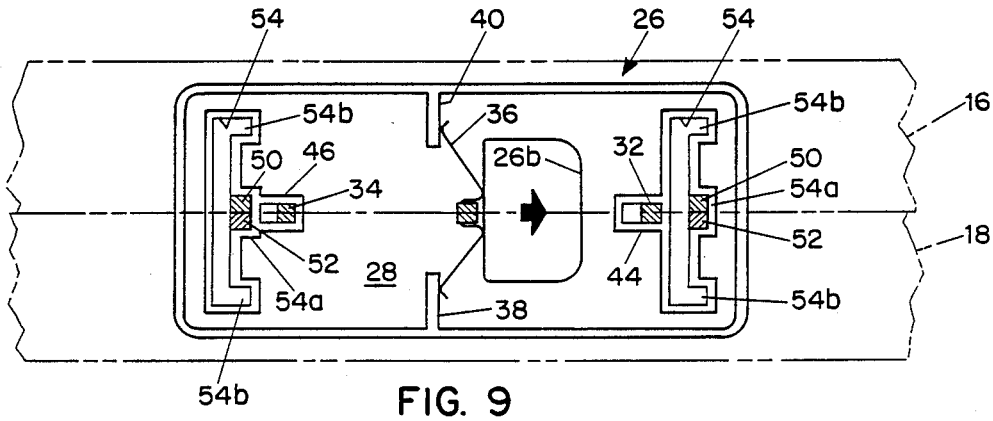
FIGS. 9 and 10 are elevational views of the internal side of a latch member and show the collapsed and expanded conditions, respectively.
Figure 10:
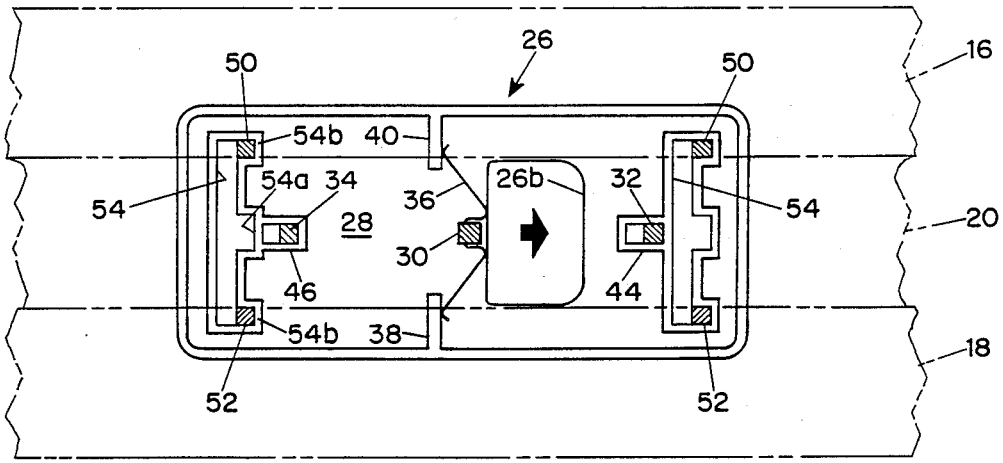
Figure 11:
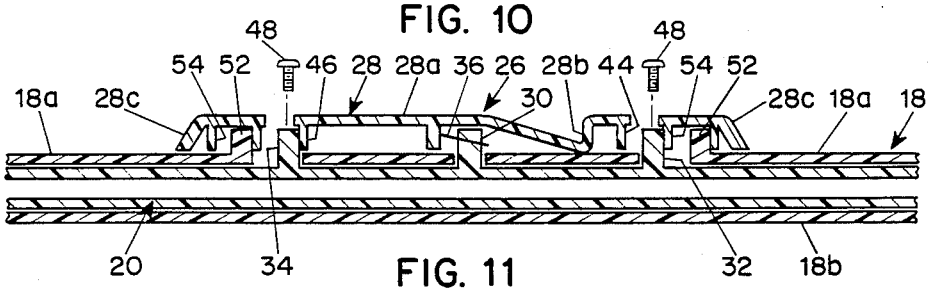
FIG. 11 is a partial longitudinal cross-sectional view typical for both latches.

Referring to FIGS. 9 to 11, the luggage is held in the collapsed and expanded conditions by simple but effective identical latches 26 installed in opposite parts of the side walls. Each latch includes a plate-like latch member 28, which is preferably molded from a rigid polymeric material such as polypropylene. The latch member 28 has a main wall portion 28*a* that is mostly flat except for a finger recess 28*b* and an turned-in peripheral flange 28*c*. Three bosses 30, 32 and 34 are molded on the inner surface of the wall portion 20*a* of the intermediate wall section 20. The center boss 30 receives a leaf spring 36 that bears against ribs 38, 40 and biases the latch member 28 to a latched position (in a direction opposite to that of the arrow, which is the release direction). The bosses 32 and 34 extend into guideways 42, 44 on the latch member and receive screws 48 for retainer plates (not shown) that slideably join the latch member to the intermediate wall member.

Bosses 50 and 52 extend in from the edges of the walls 16*a*, 18*a* of the wall sections 16, 18 into E-shaped control grooves 54 formed by ribs on the underside of the latch member. When the bosses are received in the center leg 54*a* of the "E", the luggage is held in the collapsed condition (FIG. 9). By displacing the latch against the bias of the spring 36, the bosses 50, 52 are released from the center leg 54*a* of the "E" and can move away from each other along the base of the "E". Upon release of the latch member and movement of the wall sections 16, 18 away from each other, the bosses move into the end legs 54*b* of the "E" (FIG. 10).

Figure 5:
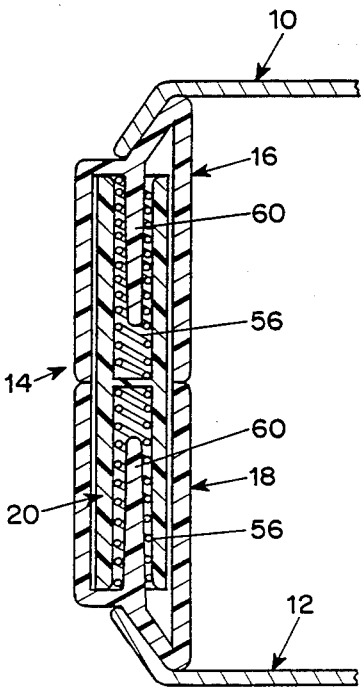
FIGS. 5 and 6 are end cross-sectional views typical for all four corners (where adjacent side walls meet) and show the collapsed and expanded conditions, respectively.
Figure 6:
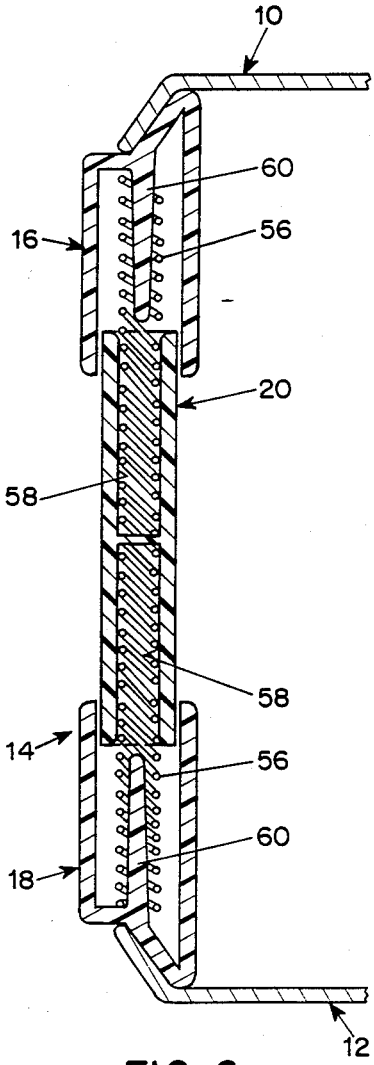
Figure 7:
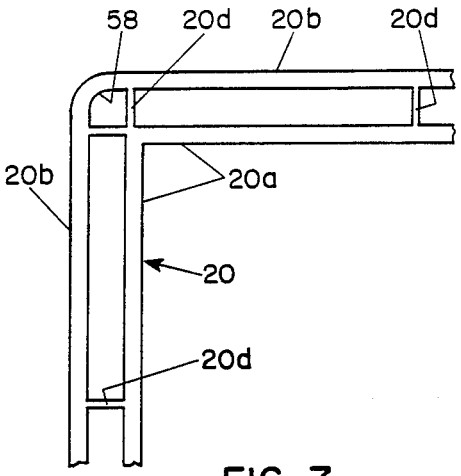
FIG. 7 is a partial plan view of the intermediate wall section.
Figure 8:
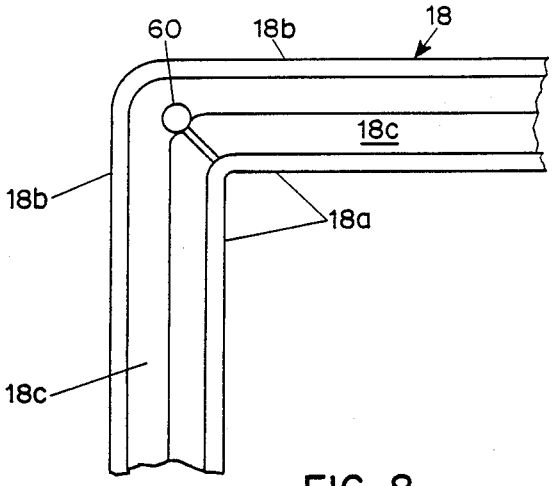
FIG. 8 is a partial plan view typical for both the top and bottom wall sections.

At the four corners of the wall 14 are coil compression springs 56 (FIGS. 5 and 6) that are received in cavities 58 (FIG. 7) in the intermediate wall section and fit over guide pins 60 in the wall sections 16 and 18 (FIG. 5, 6 and 8). When the luggage is collapsed and the latches depressed, the springs 56 push the wall sections 16 and 18 away from each other to the expanded condition. Thus attainment of the expanded condition is automatic, in that the springs 56 move the wall sections apart and the latch springs 36 seat the latch bosses 50, 52 in the legs 54*b* of the E-slot 54. To move the luggage from the expanded to the collapsed condition the latch is depressed and also pushed toward the bottom wall, thereby releasing the lugs 50, 52 from the legs 54*b* of the E-slot and moving the lugs 52 partway along the base leg of the E. After a small movement of the intermediate side wall member 20 toward the bottom wall 12, the latches can be released, whereupon the top wall can be pushed down toward the bottom wall. When the collapsed condition is attained, the latch spring 36 sets the latch to hold the collapsed condition (FIG. 9). If desired, the latch can be designed to provide additional conditions of enlargement by adding more legs to the E-slot. Also, the E-slot of the embodiment allows the luggage to be manipulated to provide a partly expanded condition in which the latch bosses of one wall section 16 or 18 remain in the center leg 54*a* of the E-slot and the others latch bosses reside in the corresponding end legs 54*b* of the E-slot. This condition is not entirely stable because of the clearance in the center leg 54*a* but is nonetheless useful, because the springs 56 maintain a level of stability and the latch spring keeps the latch set.

I claim:

1. An item of expandable luggage comprising top and bottom walls and side walls extending between the top and bottom walls to form an enclosed space, the side walls being composed of a top section, a bottom section and an intermediate section, each such section extending continuously along the walls coextensively with the perimeters of the top and bottom walls, the top and bottom sections being U-shaped in cross-section throughout their extents to form a pocket between a pair of wall parts and being oriented with the openings of the pockets facing each other, and the intermediate section being received telescopically between the wall parts in sliding relation, and latch means for retaining the top and bottom wall sections in at least two selected spacial relationships relative to each other.

2. An item of expandable luggage according to claim 1, wherein the top and bottom wall sections are identical.

3. An item of expandable luggage according to claim 2, wherein the top and bottom wall sections are of an injection-molded polymeric material.

4. An item of expandable luggage according to claim 1, wherein the intermediate section comprises inner and outer walls joined in spaced-apart relation by stiffening ribs and is of an injected-molded polymeric material.

5. An item of expandable luggage according to claim 4 and further comprising compression springs interposed between the top and bottom wall sections under compression and received between the inner and outer walls of the intermediate section within compartments defined by ribs, whereby the item automatically enlarges when the latch means is released.

6. An item of expandable luggage according to claim 1, wherein the top wall is hinged along an edge to a corresponding edge of the top wall section.

7. An item of expandable luggage according to claim 6 and further comprising a carrying handle affixed to the intermediate wall section.

8. An item of expandable luggage according to claim 1, wherein the latch means includes a latch member slidably mounted on the intermediate side wall section for movement between a release position and a latch position, at least one E-slot on the latch member, and lugs on the top and bottom wall sections received in the E-slot and adapted to be received selectively in a center leg of the E-slot or in the end legs of the E-slot.

9. An item of expandable luggage according to claim 8, wherein the latch means further includes spring means biassing the latch member toward the latched position.

* * * * *